US005257619A

United States Patent [19]

Everete

[11] Patent Number: 5,257,619

[45] Date of Patent: Nov. 2, 1993

[54] EXTERNAL CARDIAC COMPRESSION DEVICE

[76] Inventor: Randall L. Everete, P.O. Box 1543, Melrose, Fla. 32666

[21] Appl. No.: 957,367

[22] Filed: Oct. 7, 1992

[51] Int. Cl.[5] ..... A61H 31/00

[52] U.S. Cl. ..... 128/28; 128/44; 128/54

[58] Field of Search ..... 128/28, 24 R, 53, 54, 128/44, DIG. 3, 30.2; 5/503.1

[56] References Cited

U.S. PATENT DOCUMENTS

| | | | |
|---|---|---|---|
| 1,865,757 | 7/1932 | Honsowetz | 5/503.1 |
| 3,219,031 | 11/1965 | Rentsch, Jr. | 128/28 |
| 3,873,127 | 3/1975 | McNichol, Jr. et al. | 297/243 |
| 4,042,232 | 8/1977 | Lile et al. | 5/503.1 |
| 4,092,788 | 6/1978 | Gowing | 128/28 |
| 4,338,924 | 7/1982 | Bloom | 128/28 |
| 5,184,606 | 2/1993 | Csorba | 128/28 |

FOREIGN PATENT DOCUMENTS

| | | | |
|---|---|---|---|
| 1512618 | 10/1989 | U.S.S.R. | 128/24 R |

*Primary Examiner*—Richard J. Apley
*Assistant Examiner*—Jeanne M. Mollo
*Attorney, Agent, or Firm*—Alvin S. Blum

[57] ABSTRACT

A device for applying manual external cardiac massage by periodic chest compression is designed for use in transport in ambulances, helicopters, etc. It is light in weight, easy to adjust and use without fatigue in confined quarters. A plate beneath the chest holds a vertical arm in position. A horizontal arm is pivotally connected to the vertical arm and has a handle at its free end. Both vertical and horizontal arm lengths are adjustable. A resilient chest pad slidably mounted below the horizontal arm is periodically forced against the chest of a supine patient by up-down operation of the handle. The chest pad may be removed and horizontal arm locked in vertical position to serve as a support for items such as intravenous fluids. The vertical arm may be unlocked and folded down to a storage position and for ease of loading and unloading a patient. In an alternative embodiment, the support plate is replaced by a clamp assembly that clamps the device to a support member of the patient support or stretcher.

8 Claims, 1 Drawing Sheet

EXTERNAL CARDIAC COMPRESSION DEVICE

BACKGROUND OF THE INVENTION

1. Field of the Invention

This invention relates to emergency cardiac resuscitation and more specifically to a hand operated mechanical device to apply pressure impulses to the chest to cause a circulation of blood similar to that resulting from the normal beating of the heart.

2. Prior Art

It is well established that external cardiac compression and assisted ventilation are the standard of care for the immediate treatment of cardiac arrest. Since the condition is frequently encountered at a distance from a hospital, this treatment must be applied during transport by ambulance, airplane or helicopter. The recommended manual chest compression technique with the operator leaning over the patient's chest is not feasible in the confines of a rescue vehicle for the prolonged periods often required for transport. They may also be unsafe for the operator if a seat belt cannot be used. Furthermore, the operator's body may interfere with other necessary procedures.

Power driven mechanical chest compression devices may be too heavy, expensive, and awkward to use in these situations, especially if an adequate source of power must be transported as well.

SUMMARY OF THE INVENTION

It is accordingly an object of the invention to provide a hand powered, light weight, inexpensive device for applying external cardiac compression that may be operated effectively for prolonged periods without fatigue by an operator seated beside the patient. It is another object of the invention to provide a device that is readily adjusted to suit a particular patient. It is yet another object to provide such a device that is readily adaptable for use as an I.V. fluid stand. It is yet another object to provide a device that readily folds our of the way when not in use or when loading or unloading a patient.

The device comprises; a base plate that rests beneath the patient's chest; a vertical post extending up from one end of the base plate; a horizontal lever arm pivotally connected at one end to the upper end of the vertical post and provided with a hand grip at the other end. Extending downward from the lever arm is a cushioned chest pad which may be adjusted to any position on the lever arm. The length of the vertical post and the lever arm are both readily adjustable for most effective operation with a patient of a particular size and in particular operating situations. The cushioned chest pad is readily removed and replaced. Set up for a patient may be achieved in fifteen seconds.

These and other objects, features and advantages of the invention will become more apparent when the detailed description is studied in conjunction with the accompanying drawings.

DETAILED DESCRIPTION OF PREFERRED EMBODIMENTS

Figure 2:
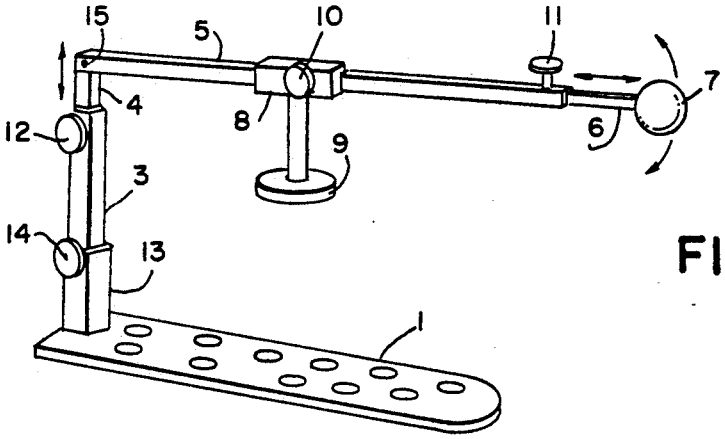
FIG. 2 is a perspective view of the device of FIG. 1.
Figure 1:
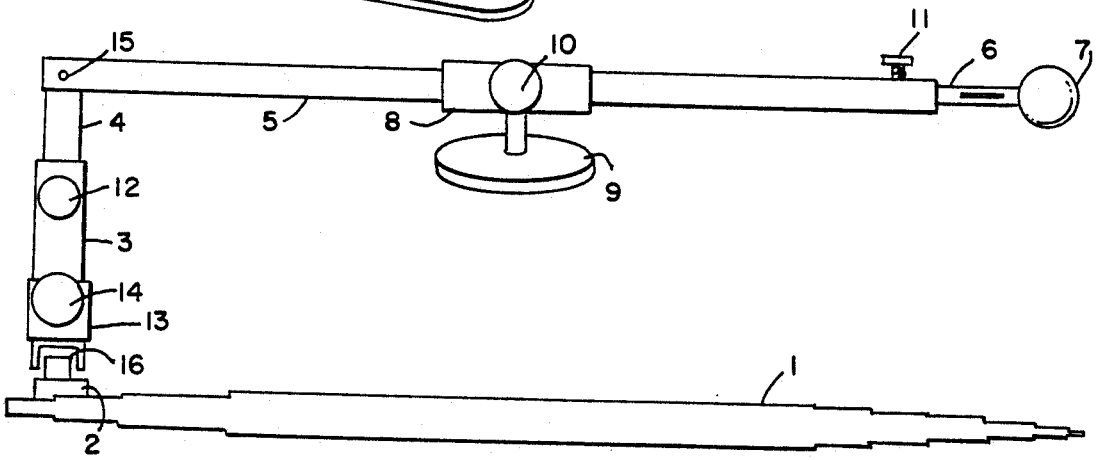
FIG. 1 is a front elevation view of a compression device of the invention.

Referring now first to FIGS. 1 and 2, a thin, flat base plate 1 slips beneath the mattress pad of a stretcher on which the patient rests. The weight of the patient then holds the assembly in place. A short, upright post 2 is permanently affixed to the base plate 1. A tubular vertical arm 3 is pivotally attached at vertical pivot connection 16 so that the vertical arm may be laid flat to be out of the way when loading and unloading the patient and when not in use. Vertical sleeve 13 with locking knob 14 slides over the pivot 16 to maintain arm 3 upright for operation. Extension bar 4 slides in tubular vertical arm 3 and may be locked in any position for adjusting height of the assembly. At the top of vertical extension bar 4, horizontal tubular compression arm 5 is pivotally connected at pivot joint 15 to permit free up and down motion of the compression arm 5. Horizontal extension rod 6, locked by locking screw knob 11 permits adjustment of the length of the compression arm as required. Handle 7 is mounted at the free end of extension rod 6 for comfortable prolonged operation. A resilient chest pad 9 is removably snap fitted onto sliding sleeve 8 which slides on arm 5 for adjusting the position of the chest pad as required. It is locked in place by locking knob 10. When the device is to be used as an I.V. pole to hold intravenous solutions and the like, the chest pad 9 may be pulled free, the arm 5 pivoted to vertical and sleeve 8 locked over the pivot joint 15 to maintain the vertical position. The vertical post, tubular member, extension bar, compression arm, and extension rod have rectangular cross sections. This inhibits rotation along the longitudinal axis of telescoping elements.

OPERATION FOR CARDIAC COMPRESSION

With the base plate 1 beneath the patient in the proper position beneath the heart, chest pad sleeve 8 is adjusted to put the pad 9 at the proper location over the patient's chest and knob 10 is tightened. Knob 12 is released and vertical bar 4 is adjusted until compression arm 5 is tilted slightly from the horizontal position, with pivot point 15 one inch below the elevation it would have if arm 5 were horizontal. Knob 12 is then tightened. Extension rod 6 is adjusted as necessary and knob 11 is tightened. The device is now ready for operation by moving handle 7 up and down.

To use for I.V. pole operation, the chest pad is snapped off, extension rod 6 is adjusted, the sleeve 8 is freed, the arm 5 is moved to vertical, joint 15 is covered by sleeve 8 which is locked in place by knob 10. Conventional hangers or brackets for I.V. fluid containers, well known in the art, may then be attached to the now upright arm 5 to provide for gravity feed of intravenous fluids.

Figure 3:
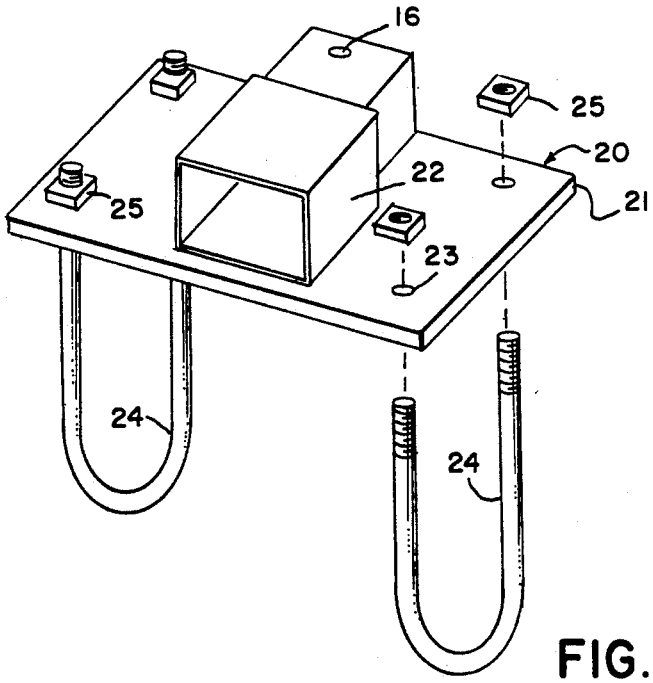
FIG. 3 is a perspective view of the lower portion of an alternative embodiment of the invention for clamping onto a bar.

Referring now to FIG. 3, an alternative embodiment with a clamp mechanism that fastens to a horizontal side bar or rod of a stretcher, bed, gurney, or the like is shown in the form of a support clamp assembly 20. This replaces the base plate 1 and post 2 of FIG. 1. A rigid rectangular clamp plate 21 supports a short vertical support bar 22 with four corner holes 23 to receive a pair of U-bolts 24 with nuts 25 which rigidly fasten to a horizontal bar (not shown) along the side of a patient-supporting stretcher, bed, gurney, or the like. The clamp plate holds support bar 22 in the vertical position with pivot connection 16 cooperating with vertical arm 3 as described above for the first embodiment.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A device for applying external cardiac compression to the chest of a supine patient, the device comprising:

A) a base plate means including a first portion adapted for positioning under the chest of a supine patient and for being held in place by the weight of said patient, and a second portion adjacent said first portion for positioning beside the chest of said patient;

B) a short vertical post fixedly connected to, and supported by, said second portion of said base plate means and extending upward therefrom;

C) an elongate tubular member pivotally connected at a first end by a first pivot means to an uppermost end of said vertical post so as to be movable between a vertical, operational position in line with said post and a horizontal, storage position alongside said patient;

D) a vertical extension bar sliding telescopically within said elongate tubular member and adjustably extending beyond a second end of said tubular member and cooperating with a first releasable locking means for releasably securing said vertical extension bar to said tubular member at a selected position;

E) an elongate tubular compression arm pivotally connected at a first end thereof by a second pivot means to an end of said vertical extension bar extending from said tubular member so as to move between a fixed position in line with said extension bar and a movable horizontal position above a patient's chest for cardiac compression;

F) a chest pad holder, slidably mounted on said compression arm with a second releasable locking means for releasably securing said pad holder at a continuously adjustable horizontal position along said compression arm selected for enhanced cardiac compression;

G) a resilient chest pad removably attached to said pad holder and extending below said compression arm when said compression arm is horizontal;

H) a horizontal extension rod sliding telescopically within said compression arm and adjustably extending beyond an end of said compression arm away from said second pivot means and cooperating with a third releasable locking means for releasably securing said extension rod to said compression arm at a selected position;

I) handle means mounted at a free end of said extension rod for grasping with an operator's hand for up and down motion to be transmitted to said chest pad for periodic chest compression;

J) a locking sleeve means slidably mounted on said elongate tubular member and arranged for sliding over said first pivot means for fixing said tubular member in line with said vertical post to position said tubular member and said extension bar in vertical, operating position, said first locking sleeve means being provided with a sleeve lock to releasably secure said locking sleeve in position on said tubular member; and K) said chest pad holder arranged for removably sliding over said second pivot means for fixing said compression arm in line with said tubular member in vertical position for use as a support for items.

2. The device according to claim 1, in which said vertical post, said tubular member, said extension bar, said compression arm, and said extension rod have rectangular cross sections.

3. A device for applying external cardiac compression to the chest of a supine patient resting upon a patient support, the patient support having as elongate horizontal supporting member extending alongside the patient, the device comprising:

A) a clamp means for removably clamping to a horizontal supporting member of a patient support;

B) a short vertical post fixedly connected to, and supported by, said clamp means and extending upward therefrom when said clamp means is clamped onto a horizontal supporting member;

C) an elongate tubular member pivotally connected at a first end by a first pivot means to an uppermost end of said vertical post so as to be movable between a vertical, operational position in line with said post and a horizontal, storage position alongside said patient;

D) a vertical extension bar sliding telescopically within said elongate tubular member and adjustably extending beyond a second end of said tubular member and cooperating with a first releasable locking means for releasably securing said vertical extension bar to said tubular member at a selected position;

E) an elongate tubular compression arm pivotally connected at a first end thereof by a second pivot means to an end of said vertical extension bar extending from said tubular member so as to move between a fixed position in line with said extension bar and a movable horizontal position above a patient's chest for cardiac compression;

F) a chest pad holder, slidably mounted on said compression arm with a second releasable locking means for releasably securing said pad holder at a continuously adjustable horizontal position along said compression arm selected for enhanced cardiac compression;

G) a resilient chest pad removably attached to said pad holder and extending below said compression arm when said compression arm is horizontal;

H) a horizontal extension rod sliding telescopically within said compression arm and adjustably extending beyond an end of said compression arm away from said second pivot means and cooperating with a third releasable locking means for releasably securing said extension rod to said compression arm at a selected position;

I) handle means mounted at a free end of said extension rod for grasping with an operator's hand for up and down motion to be transmitted to said chest pad for periodic chest compression;

J) a locking sleeve means slidably mounted on said elongate tubular member and arranged for sliding over said first pivot means for fixing said tubular member in line with said vertical post to position said tubular member and said extension bar in vertical, operating position, said first locking sleeve means being provided with a sleeve lock to releasably secure said locking sleeve in position on said tubular member; and K) said chest pad holder arranged for removably sliding over said second pivot means for fixing said compression arm in line with said tubular member in vertical position for use as a support for items.

4. The device according to claim 3, in which said vertical post, said tubular member, said extension bar, said compression arm, and said extension rod have rectangular cross sections.

5. An external cardiac compression device for manual application of periodic compression forces to the chest of a patient lying supine on a patient support, the device comprising:

A) a patient support-engaging means for cooperating with a patient support while a patient is lying thereon to securely support the device in operating position for cardiac compression;

B) a vertical arm having a first end fixed to said support-engaging means and extending upward therefrom;

C) an adjustably extensible, elongate vertical member pivotally connected at one end to a second end of said vertical arm by a first joint means;

D) an adjustably extensible, elongate, compression member pivotally connected at a first end to another end of said vertical member by a second joint means and provided with a handle at a second end;

E) a chest pad holder slidably mounted on said compression member for releasably securing said holder at a continuously adjustable horizontal position along said compression member;

F) a resilient chest pad, removably mounted on said chest pad holder, for applying pressure to a chest when said handle is forced downward;

G) first joint fixing means for removably fixing said first joint with said vertical member vertical and in line with said vertical arm in a first, operating mode for cardiac compression and for providing for moving said vertical member to a horizontal position in a second, storage mode; and H) second joint fixing means for removably fixing said second joint with said compression member vertical and in line with said vertical member in a support mode for supporting items and for freely moving said compression member while horizontal in a compression mode of operation when said second joint is not fixed.

6. The device according to claim 5, in which said chest pad holder also functions as said second joint fixing means.

7. The device according to claim 6, in which said patient support-engaging means includes a support plate that is held against a patient support by a patient lying thereon to secure the device in position for use.

8. The device according to claim 6, in which said patient support-engaging means includes a clamp means for clamping onto a horizontal support member of a patient support.

* * * * *

UNITED STATES PATENT AND TRADEMARK OFFICE

CERTIFICATE OF CORRECTION

PATENT NO. : 5,257,619

DATED : November 2, 1993

INVENTOR(S) : Randall L. Everett

It is certified that error appears in the above-indentified patent and that said Letters Patent is hereby corrected as shown below:

Title page, item [76], inventor: should be--Randall L. Everett--.

Signed and Sealed this

Twenty-first Day of November, 1995

Bruce Lehman

*Attest:*

BRUCE LEHMAN

*Attesting Officer*

*Commissioner of Patents and Trademarks*